United States Patent [19]

del Pozo

[11] 4,172,299

[45] Oct. 30, 1979

[54] FLUSH VALVE FOR WATER TANK IN A TOILET SYSTEM

[76] Inventor: Joaquin G. del Pozo, 1274 SW. 5th St., Miami, Fla. 33135

[21] Appl. No.: 865,982

[22] Filed: Dec. 30, 1977

[51] Int. Cl.[2] ..... E03D 1/14; E03D 5/092; E03D 5/094; F16H 21/44

[52] U.S. Cl. ..... 4/326; 4/393; 4/414; 74/96; 74/471 R

[58] Field of Search ..... 4/324, 325, 326, 345, 4/392, 393, 378, 405, 411–415; 74/96, 519, 523, 53, 479, 481, 501 R, 471 R

[56] References Cited

U.S. PATENT DOCUMENTS

| | | | |
|---|---|---|---|
| 2,731,647 | 1/1956 | Groth et al. | 4/326 |
| 2,839,759 | 6/1958 | Martino | 4/326 |
| 2,864,095 | 12/1958 | Martino | 4/326 |
| 3,777,316 | 12/1973 | Coetzee | 4/324 |
| 3,903,550 | 9/1975 | Wilhelm | 4/326 |
| 3,909,856 | 10/1975 | Dunn, Jr. | 4/326 |
| 4,003,097 | 1/1977 | Book | 4/326 |
| 4,011,604 | 4/1977 | Goldsworthy | 4/326 |
| 4,096,591 | 6/1978 | Awis | 4/326 |

FOREIGN PATENT DOCUMENTS

| | | | |
|---|---|---|---|
| 119698 | 3/1945 | Australia | 4/414 |

*Primary Examiner*—Stuart S. Levy

[57] ABSTRACT

A dual control for selectively releasing different amounts of water from a toilet flush tank, the device including a bifurcated activating handle and arm connected by a lever and chains to first and second stoppers that seat at different vertical positions on a hallow tower.

4 Claims, 1 Drawing Figure

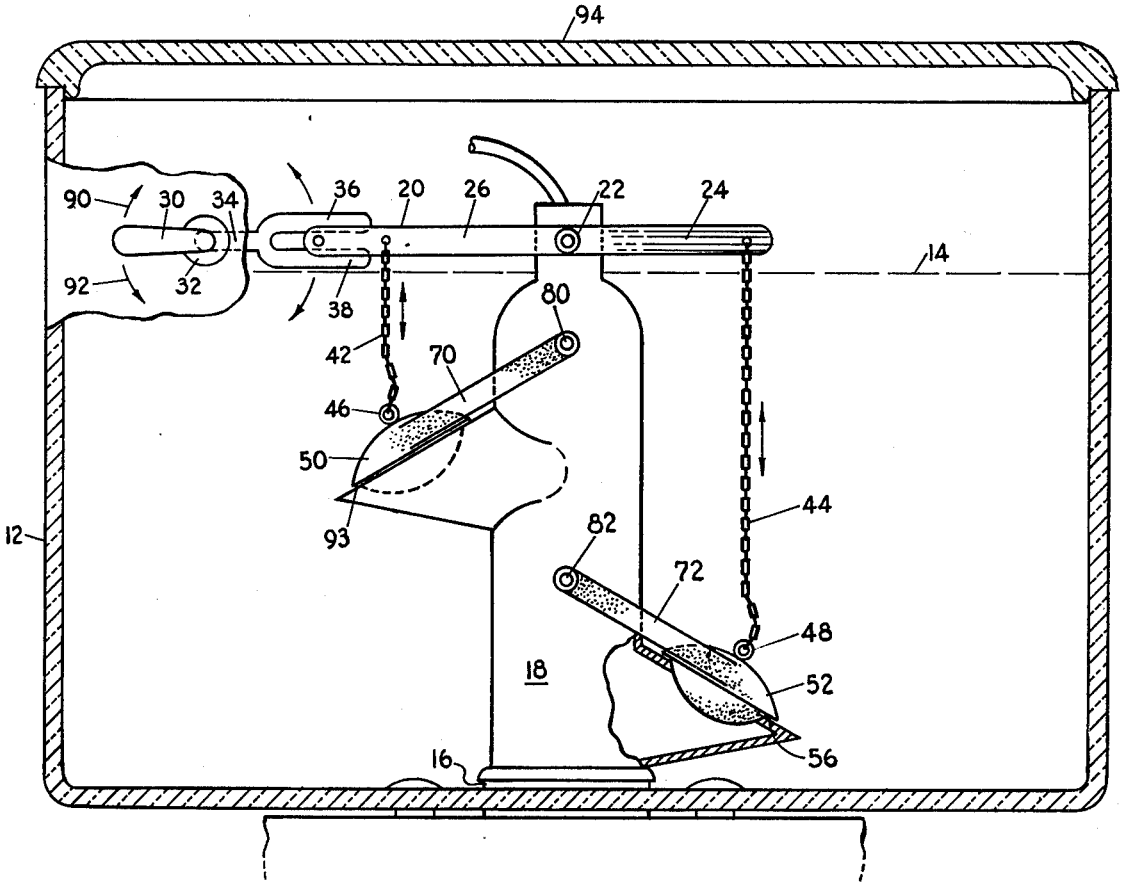
94
90
30
34
36
20
26
22
24
14
92
32
38
80
42
70
46
50
93
44
12
82
72
48
18
52
16
56

FLUSH VALVE FOR WATER TANK IN A TOILET SYSTEM

FIELD OF THE INVENTION

This invention relates to a dual flush control valve for a water tank of a toilet system.

BACKGROUND OF THE INVENTION

Up to the present days, there have been other types of devices to release water to flow from a water tank to flush the toilet. This invention is of such a device. The problem in the past has been that, oftentimes, too much water has been and still is utilized in flushing a toilet. Sometimes it is required to have a heavy flush that is to cause much water to be released, relatively speaking. At other times, a light flush is all that is necessary and wastage of water occurs. This invention is of a dual flush control whereby, at the option of the user, a heavy flush or a light flush of water of a toilet system may be accomplished.

OBJECTS OF THE INVENTION

It is an object of this invention to provide a dual control for releasing water in a tank with a main drain and which includes a tower with an upper opening and a lower opening, each of which is closed by a stopper and which stoppers may be selectively lifted by pivotal movement of a lever connected by chains to the stoppers, whereby when the lever is tilted in either direction, one of the openings, but not the other, will be uncovered since the chain, by the pivotal action, will lift one of the stoppers from the opening and cause a flush to occur; thus, either a light flush or a heavy flush of water from the tank may be caused at the option of the user.

In accordance with these and other objects which will become apparent hereinafter the instant invention will now be described with reference to the accompanying drawing.

DESCRIPTION OF THE DRAWING

The drawing is of a water tank in cross section of the type used in toilet systems and wherein the instant invention is illustrated in a figure partly in cross section.

DESCRIPTION OF PREFERRED EMBODIMENT

Referring to the drawing there is shown a container, in cross section, which is conventional, designated by the numeral 12, which has a water level 14 and an upright tower having lower, intermediate and upper zones circumposed about and extending upwardly from a drain opening 16, the tower being designated by the numeral 18. To the open end of the tower there is provided a lever 20 which is pivotally connected as at 22 with a portion 24 extending in one direction and a portion 26 extending in the other direction. The lever is adapted to be tilted in either a clockwise or counterclockwise direction by an operator 30 which, in the embodiment shown is a rotatable handle on a pivot means 32 with an arm 34 extending from it that is bifurcated as at 36 and 38 with those legs embracing the opposite sides of the terminal end of one end of the lever. In depending relation from each of the levers there is a chain provided, a relatively short chain 42 and a relatively long chain 44. On the lower end of each chain there is a fastener means 46 and 48 respectively which support stopper means 50 and 52 respectively.

The stopper means nest in a seat, as at 56, in an upwardly facing mouth as shown and the stoppers are each on swingable lever arms 70 and 72 respectively which are pivotally connected to the tower as at 80 and 82. The interior of the tower comprises a column through which water may flow. It is thus seen that a person may, by turning the handle 30 in the direction indicated by the arrow 90, cause a tension force to pull upwardly on the chain 44 opening the stopper 52 by unseating it from the mouth 56, with the result that the water level 14 will run out through the mouth down to the level of it and flush the toilet with substantially a full tank of water flowing through the toilet. Alternatively, the handle could be pushed in the direction indicated by the arrowed line 92, in which event, the chain 42 would lift the stopper 50 from the seat of a mouth, similar to that at the lower right and designated in this instance by the number 93, in which event the water level 14 would descend to the level of that mouth but no lower, which would result in a flushing of the tank by approximately a one-half tank of water flowing through the toilet system.

In this manner, there is provided a simple and inexpensive means for controlling and selecting the amount of water to be used, namely, whether a heavy flush or a light flush. As is conventional, the cap 94 of the tank may be removed for access to the tower.

What is claimed is:

1. A dual control for releasing water from a holding tank of a toilet system wherein the tank has a floor and a main drain, comprising:

a hollow upstanding tower having an upper end zone and a lower end zone and defining a through passageway between the end zones, said lower end zone including means to connect to the main drain of the tank for fluid communication with the hollow of the tower, said upper end zone having an outwardly extending throat means terminating at an upper, upwardly facing opening in fluid communication with the tower passageway and said upper opening being at a first predetermined height above the floor and comprising first seat means, said tower including an intermediate zone between said upper opening and the lower end zone and said intermediate zone having an outwardly extending throat means terminating at a lower upwardly facing opening in fluid communication with the tower passageway at a second predetermined height below said first predetermined height and comprising second seat means, said openings each having a center on opposite sides of the tower and defining a reference plane, an operator lever aligned with said reference plane and said lever having a first end and a second end and means pivotally connecting the lever between the first and second ends to the upper end zone of the tower above the upper opening, a flush tank actuating handle, said handle including a bifurcated arm pivotally coupled to said first end of said operator lever, a first lever pivotally connected to the tower above said upper opening and a second lever pivotally connected to the tower above said lower opening and each of said levers having a free outer end, first and second stopper means seated on each of said first and second seat means and normally closing the upper and lower openings, and connected to said first and second lever outer ends respectively, first chain means connecting the first end of the operator lever to said first stopper means seated on said upper opening and second chain means connecting the second end of the operator lever to said second stopper means seated on said second opening, each of said first and second chain means being of a predetermined length neither too loose nor taught when said first and second stopper means are in seated engagement with said first and second openings, whereby, when the operator lever is tilted in one direction of rotation by movement of said flush tank actuating handle, said first stopper means will be lifted from the first seat means permitting water to flow through the upper opening and when the operating lever is tilted in the other direction of rotation, the second stopper means will be lifted from the second seat means of the lower opening to permit water to flow through the passageway of the tower effecting, optionally, a heavy flush or a light flush.

2. The device as set forth in claim 1 wherein the tower is generally cylindrical terminating at an upper domed zone and including a distally upwardly projecting cylindrical portion of reduced diameter.

3. The device as set forth in claim 1 wherein the first and second ends of said operating lever extend over said first and second openings respectively in opposite directions from said tower.

4. The device as set forth in claim 1 wherein the outer end of said first lever and the outer end of said second lever each extend over one of said openings in opposite directions from said tower.

* * * * *